US010871015B1

(12) United States Patent
Rioux et al.

(10) Patent No.: US 10,871,015 B1
(45) Date of Patent: Dec. 22, 2020

(54) PROTRACTING BLOCKER FOR DOORS EQUIPPED WITH A CLOSER PISTON

(71) Applicants: Alain Rioux, Laval (CA); Kevin Gosselin, Terrebonne (CA)

(72) Inventors: Alain Rioux, Laval (CA); Kevin Gosselin, Terrebonne (CA)

( * ) Notice: Subject to any disclaimer, the term of this patent is extended or adjusted under 35 U.S.C. 154(b) by 0 days.

(21) Appl. No.: 16/521,668

(22) Filed: Jul. 25, 2019

(51) Int. Cl.
*E05F 5/02* (2006.01)
*E05C 17/34* (2006.01)
*E05F 3/22* (2006.01)

(52) U.S. Cl.
CPC ..... *E05C 17/34* (2013.01); *E05F 3/221* (2013.01)

(58) Field of Classification Search
CPC ... Y10T 16/469; Y10T 16/459; Y10T 16/462; E05C 17/02; E05C 17/54; E05C 17/34; E05C 17/32; E05F 3/221
See application file for complete search history.

(56) References Cited

U.S. PATENT DOCUMENTS

| | | | | |
|---|---|---|---|---|
| 832,603 | A | 10/1906 | Fritts | |
| 1,573,404 | A | 2/1926 | Hurd | |
| 1,785,342 | A | 12/1930 | Gilbert | |
| 1,879,274 | A | 9/1932 | Isley | |
| 1,925,386 | A | 9/1933 | Hurd | |
| 2,010,937 | A | 8/1935 | Voight | |
| 2,104,172 | A | 1/1938 | Sibley | |
| 3,089,568 | A | 5/1963 | Thompson | |
| 3,259,936 | A * | 7/1966 | Sheridan | E05C 17/32 16/49 |
| 3,563,592 | A | 2/1971 | Preston | |
| 3,674,299 | A * | 7/1972 | Kelley | E05C 17/042 292/262 |
| 3,877,108 | A * | 4/1975 | Del Fiacco | E05F 3/221 16/49 |
| 3,909,877 | A * | 10/1975 | Christy | E05F 3/221 16/85 |

(Continued)

FOREIGN PATENT DOCUMENTS

| | | | | |
|---|---|---|---|---|
| EP | 0398196 A2 * | 11/1990 | | E05C 17/28 |
| GB | 914638 A * | 1/1963 | | E05F 3/16 |

(Continued)

*Primary Examiner* — Chuck Y Mah

(57) ABSTRACT

An angularly variable device for use on a door having a closer piston with a piston arm wherein the angularly variable device is a protracting blocker comprised of a first section and a second section. Each section comprises a wall from which extends at least one tab extending perpendicularly therefrom. From the wall extends generally perpendicularly at least one but preferably a plurality of tabs so that the at least one tab on each of the first section and the second section rests on top of the piston arm. A retainer presses against an elbow joint forming part of the piston arm so as to firmly press the wall against the piston arm so that one side of the blocker is pressed against one side of the piston arm while the retainer presses against the opposite side of the piston arm so as to provide a secure installation of the blocker on the piston arm. A lever pivoted into a horizontal position presses the two sections together so that they remain in a given fixed position relative to each other so as to immobilize the piston arm in a given position.

18 Claims, 9 Drawing Sheets

(56) References Cited

U.S. PATENT DOCUMENTS

| | | | | | |
|---|---|---|---|---|---|
| 3,911,526 | A * | 10/1975 | Christy | E05F 3/00 16/49 |
| 4,102,005 | A * | 7/1978 | Schnarr | E05F 3/221 16/49 |
| 4,114,235 | A | 9/1978 | Remington | |
| 4,751,766 | A | 6/1988 | Fahs et al. | |
| 4,756,052 | A * | 7/1988 | Diedrich | E05C 17/54 16/82 |
| 5,517,720 | A * | 5/1996 | Anderson | E05C 17/32 16/80 |
| 5,551,740 | A * | 9/1996 | Lin | E05F 3/221 292/262 |
| 6,612,628 | B1 * | 9/2003 | Herbst | E05C 17/34 16/324 |
| 6,904,643 | B2 | 6/2005 | Duffy | |
| 7,340,801 | B2 | 3/2008 | Yamaguchi | |
| 7,721,386 | B2 * | 5/2010 | McKinney | E05F 3/221 16/63 |

FOREIGN PATENT DOCUMENTS

| | | | | |
|---|---|---|---|---|
| JP | 11336406 | A * | 12/1999 | |
| JP | 2002256757 | A * | 9/2002 | |
| JP | 2004060228 | A * | 2/2004 | |
| JP | 2006052534 | A * | 2/2006 | E05F 3/16 |
| JP | 2014218775 | A * | 11/2014 | |

* cited by examiner 31
36

38

PROTRACTING BLOCKER FOR DOORS EQUIPPED WITH A CLOSER PISTON

CROSS-REFERENCE TO RELATED APPLICATIONS

The present application claims priority to United Kingdom Patent Application serial number GB1812227.5 filed on Jul. 26, 2018 entitled "Protracting blocker for doors equipped with a closer piston", the disclosure of which is hereby incorporated in its entirety at least by reference.

BACKGROUND OF THE INVENTION

1. Field of the Invention

The present invention relates generally to to door blocking mechanisms but more particularly to a protracting blocker for doors equipped with a closer piston.

2. Description of Related Art

Keeping open a door equipped with a closer piston can be quite annoying. In some instances those doors are equipped with a flip down friction stopper but when they;re not, one has to resolve to makeshift methods such as jamming a piece of wood between the door and its casing, which can result in damage to one or both parts. In other instances, one tries to see if the piston model makes it easy to disable it. Essentially, there is no one universal and quick device to solve this problem.

BRIEF SUMMARY OF THE INVENTION

It is a main advantage of this invention to provide for a protracting blocker for doors equipped with a closer piston.

In order to do so, the invention comprises an angularly variable device for use on a door having a closer piston with a piston arm wherein the angularly variable device is a protracting blocker comprised of a first section and a second section. Each section comprises a wall from which extends at least one tab extending perpendicularly therefrom. From the wall extends generally perpendicularly at least one but preferably a plurality of tabs so that the at least one tab on each of the first section and the second section rests on top of the piston arm. A retainer presses against an elbow joint forming part of the piston arm so as to firmly press the wall against the piston arm so that one side of the blocker is pressed against one side of the piston arm while the retainer presses against the opposite side of the piston arm so as to provide a secure installation of the blocker on the piston arm. A lever pivoted into a horizontal position presses the two sections together so that they remain in a given fixed position relative to each other so as to immobilize the piston arm in a given position.

The first section and the second section are rotationally connected at an axis point through which passes a rod which has a means for biasing at its distal end, and has the lever pivotally attached at its proximal end.

When the lever presses against the first section, it pushes the first section against the second section.

A first and a second sprocket from the first section meshes with a third and fourth sprocket located on the second section by way of sets of teeth forming part of the first, second, third and fourth sprockets so as to immobilize the first section and the second section.

The rod holds the first section and the second section together by way of attaching with the lever by way of a pin.

A bracket holds the retainer and is pivotally attached on top of the first section at the axis point by way of the rod passing through a rod hole.

The bracket has an opening made through the bracket so that a nipple extending perpendicularly from the retainer can be inserted therein to hold the retainer in place.

The second section has a bushing acting as a pivot point for the first section and the second section.

Each of the first section and a second section is shaped like a "C" and comprises a top member, a bottom member and the wall to join the top member and bottom member.

The protracting door blocker works in combination with a door having and a closer piston having a piston arm.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiment, and its several details are capable of modifications in various obvious respects, all without departing from the invention. Accordingly, the drawings and description are to be regarded as illustrative in nature, and not as restrictive.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein.

Figure 1:
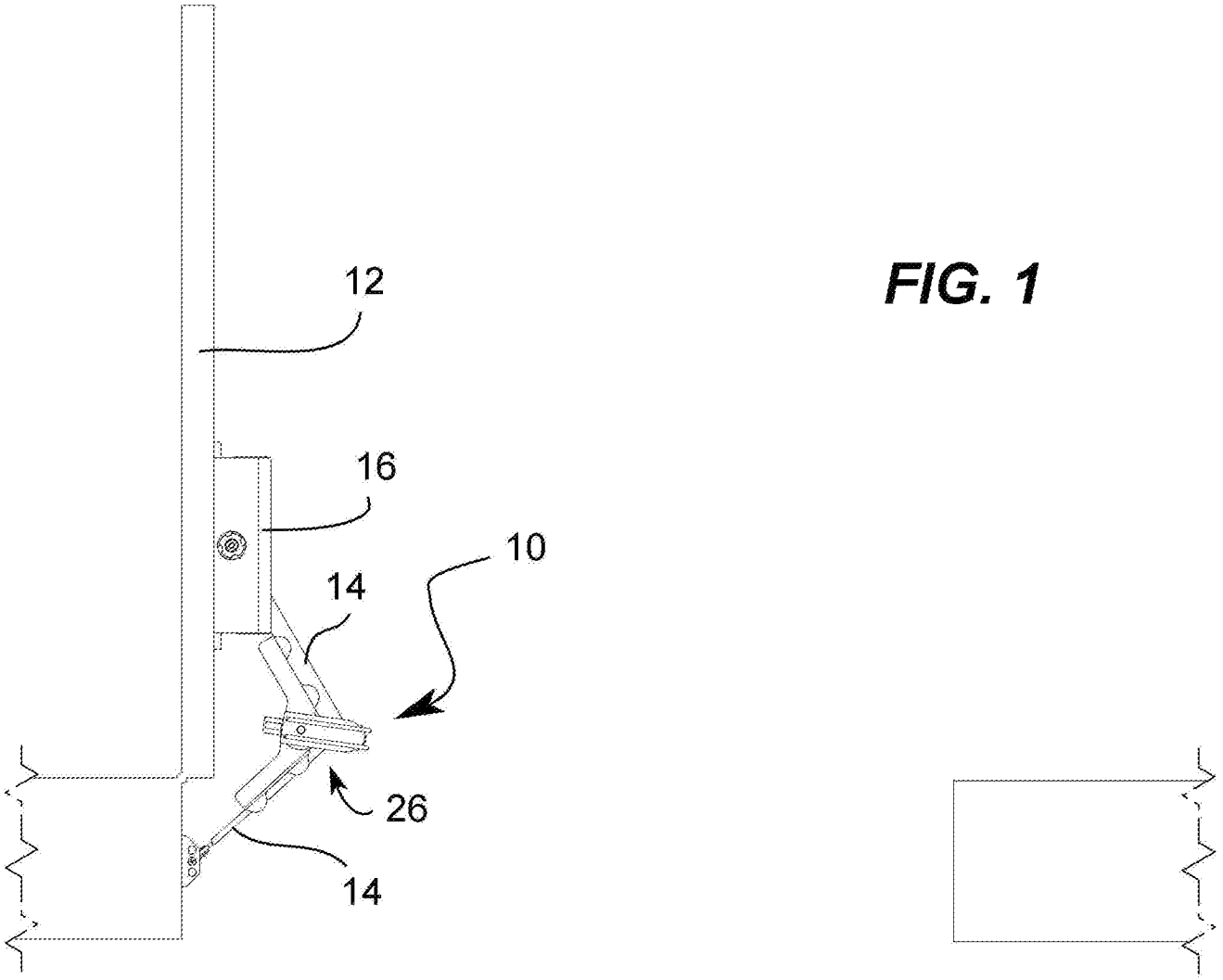
FIG. 1 is a top view of the invention in context of use, according to an embodiment of the present invention.
Figure 2:
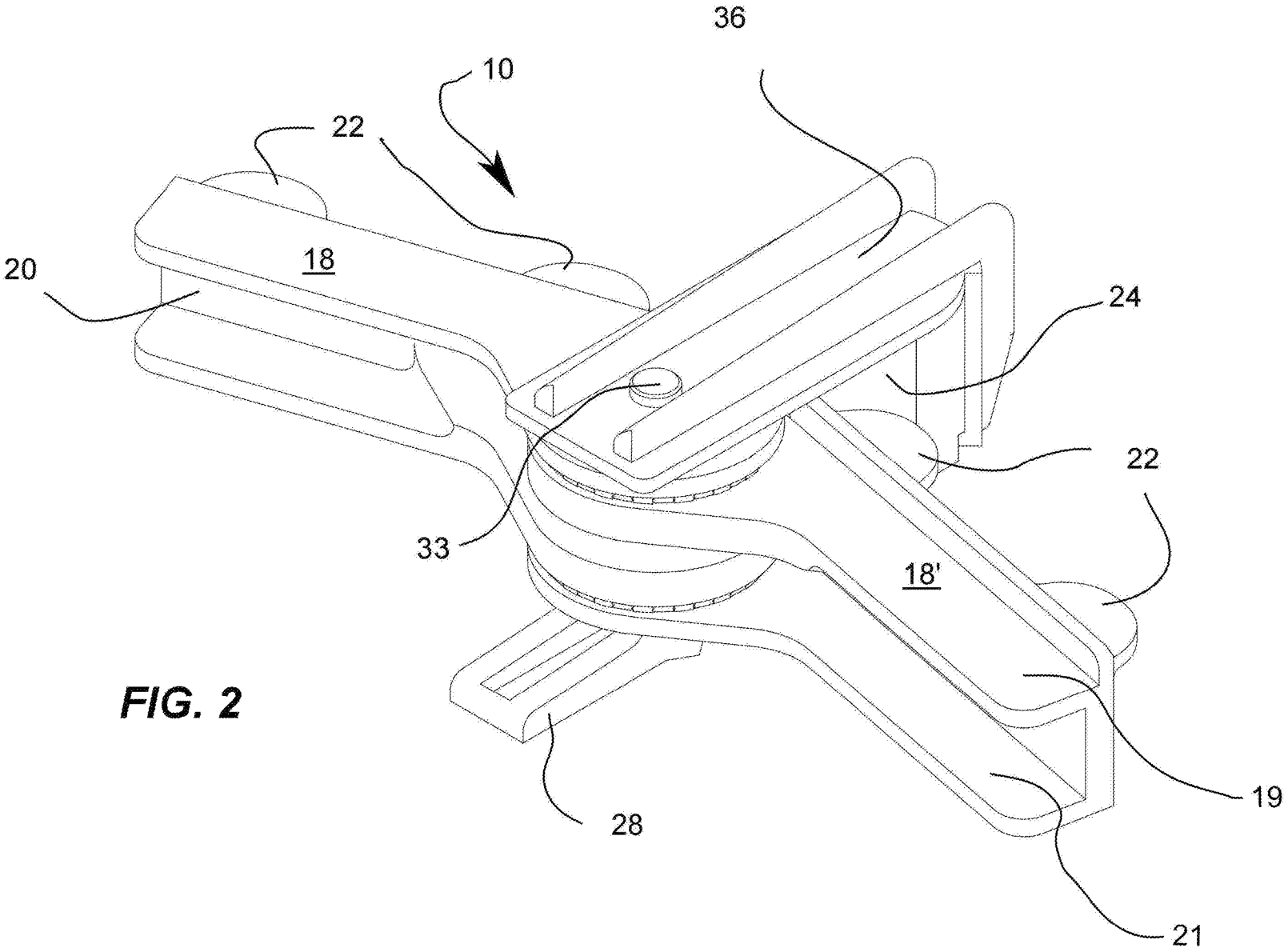
FIG. 2 is an isometric view, of the protracting blocker according to an embodiment of the present invention in its protracted configuration.
Figure 3B:
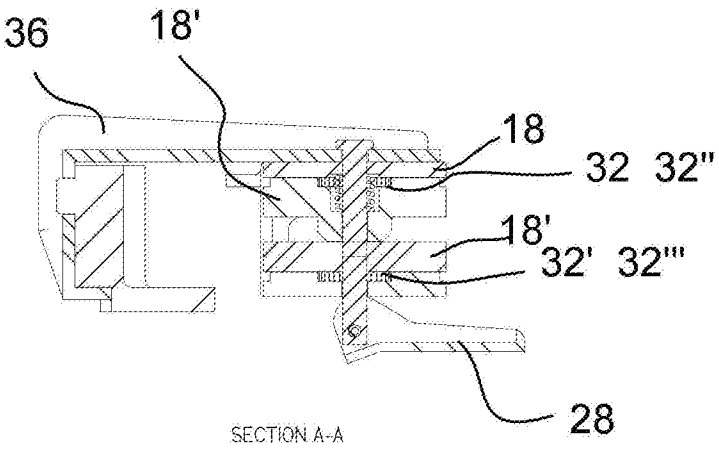
FIG. 3AB are a top and a cutaway side view, respectively, according to an embodiment of the present invention.
Figure 3A:
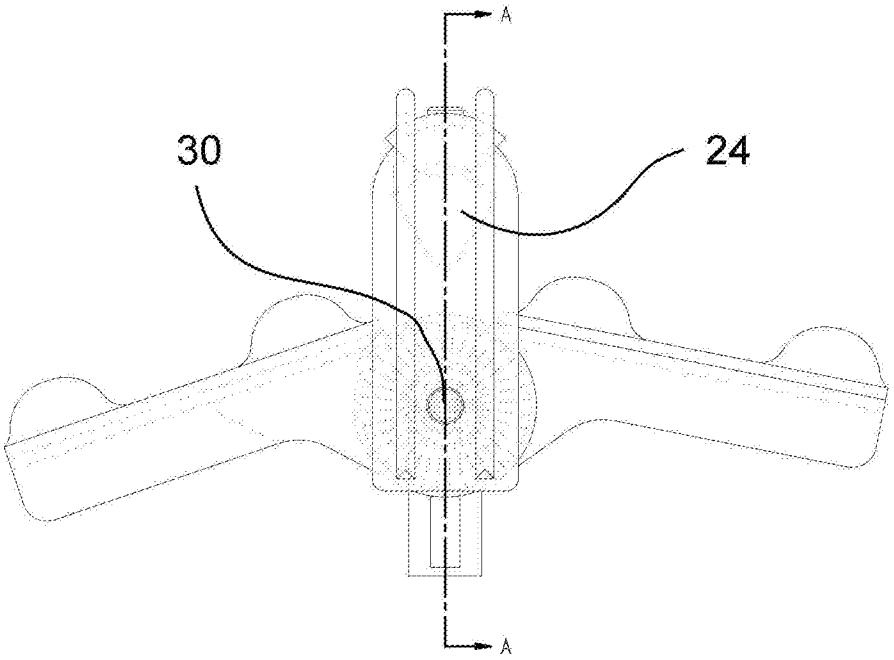
Figure 4B:
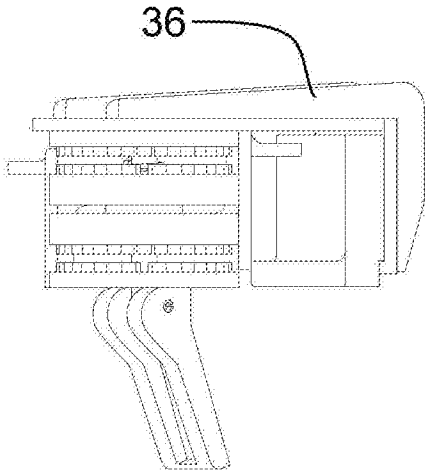
FIGS. 4A-D are front views of the invention in open (protracted) and closed (retracted) positions and with the lever disengaging and engaging the sprockets, respectively.
Figure 4D:
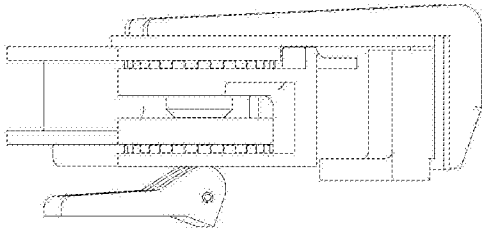
Figure 4A:
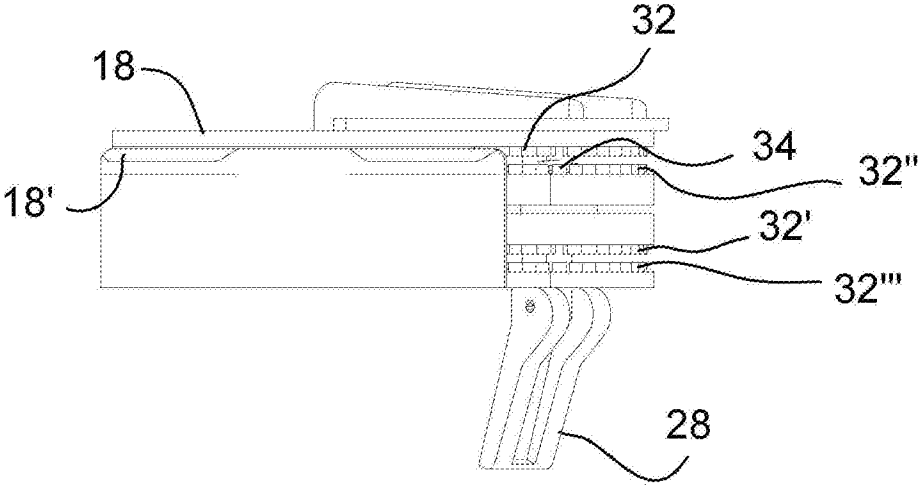
Figure 4C:
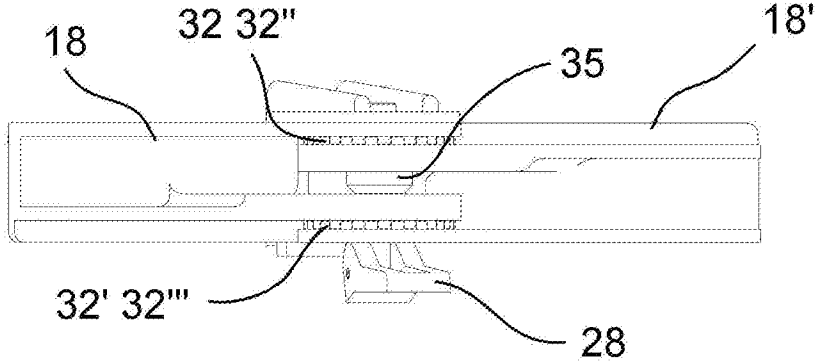
Figure 5:
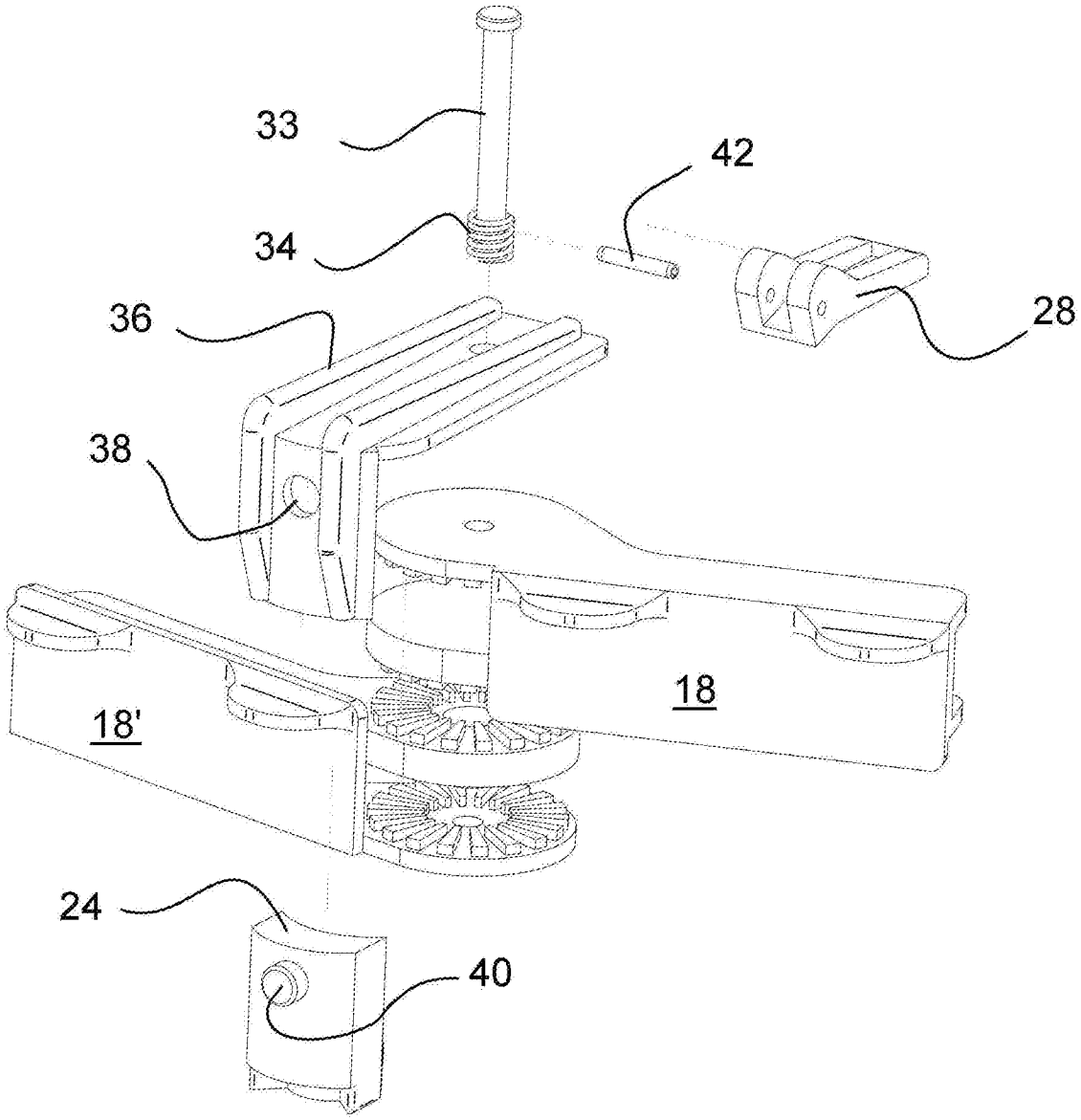
FIG. 5 is an exploded view, according to an embodiment of the present invention.
Figure 6A:
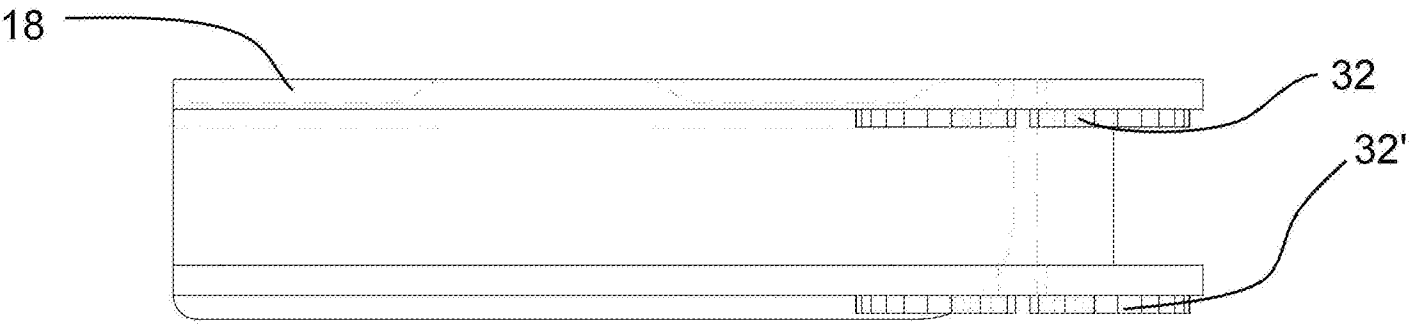
FIGS. 6A-B are side views of the first section and the second section, respectively, according to an embodiment of the present invention.
Figure 6B:
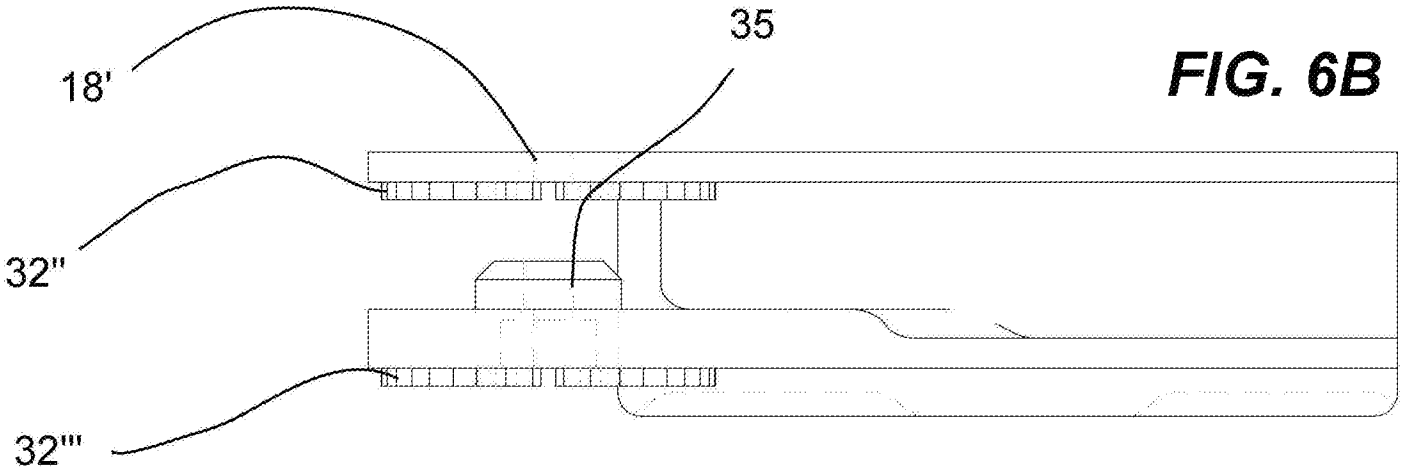
Figures 7A, 7B, 7C:
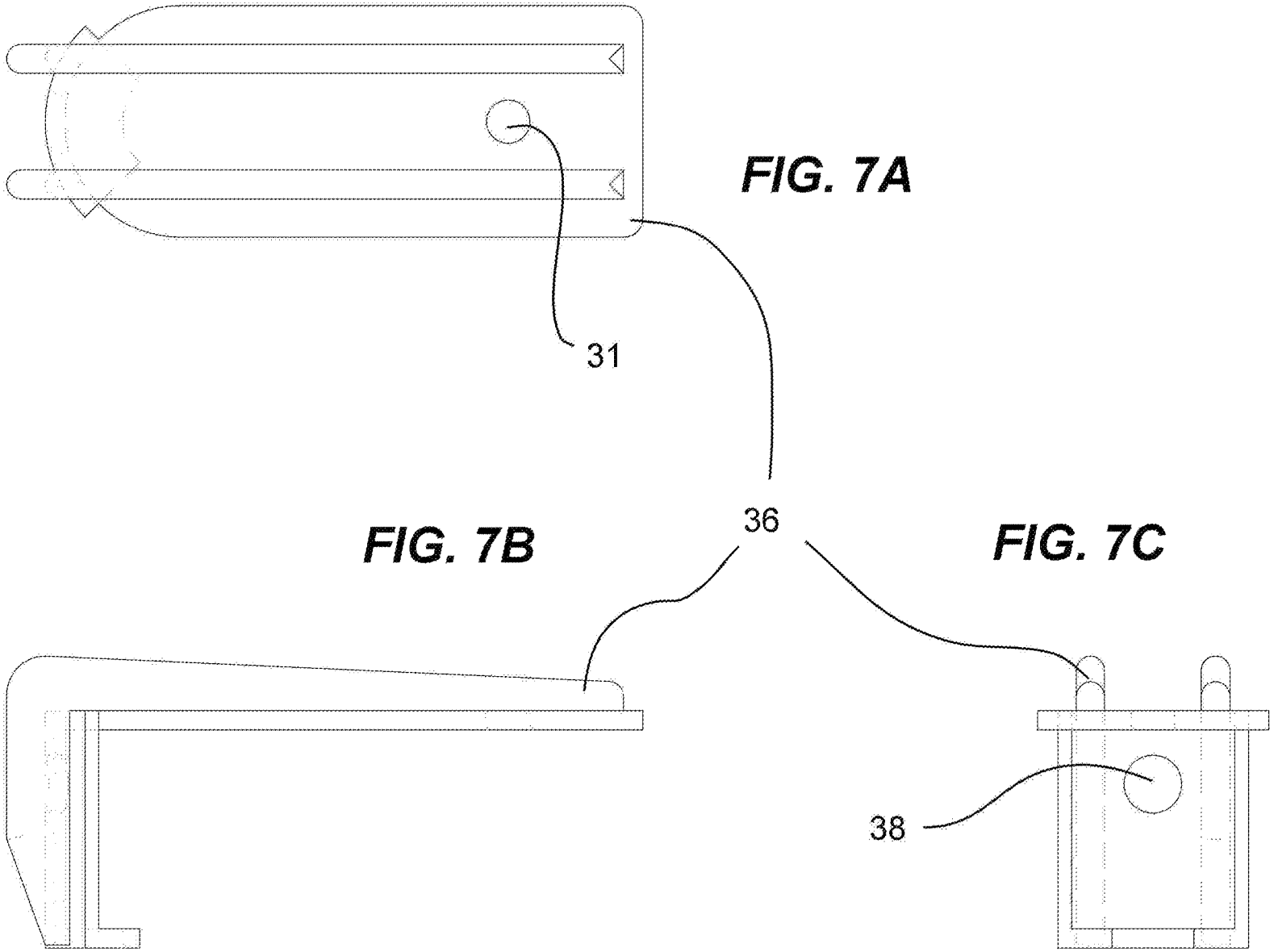
FIGS. 7A-C Top, side and front views, respectively, of the bracket, according to an embodiment of the present invention.
Figure 8A:
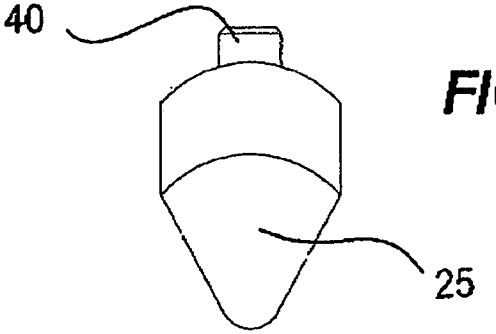
FIGS. 8A-C Top, front, and side views, respectively, of the retainer, according to an embodiment of the present invention.
Figure 8B:
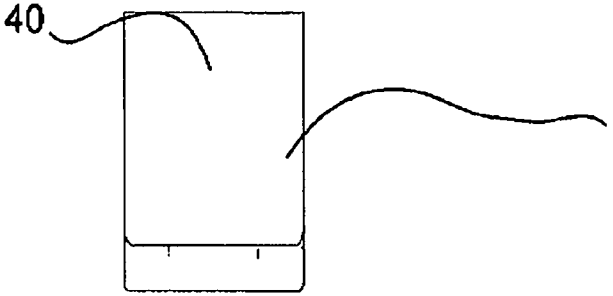
Figure 8C:
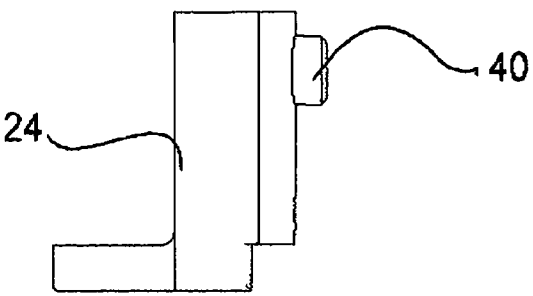
Figure 9:
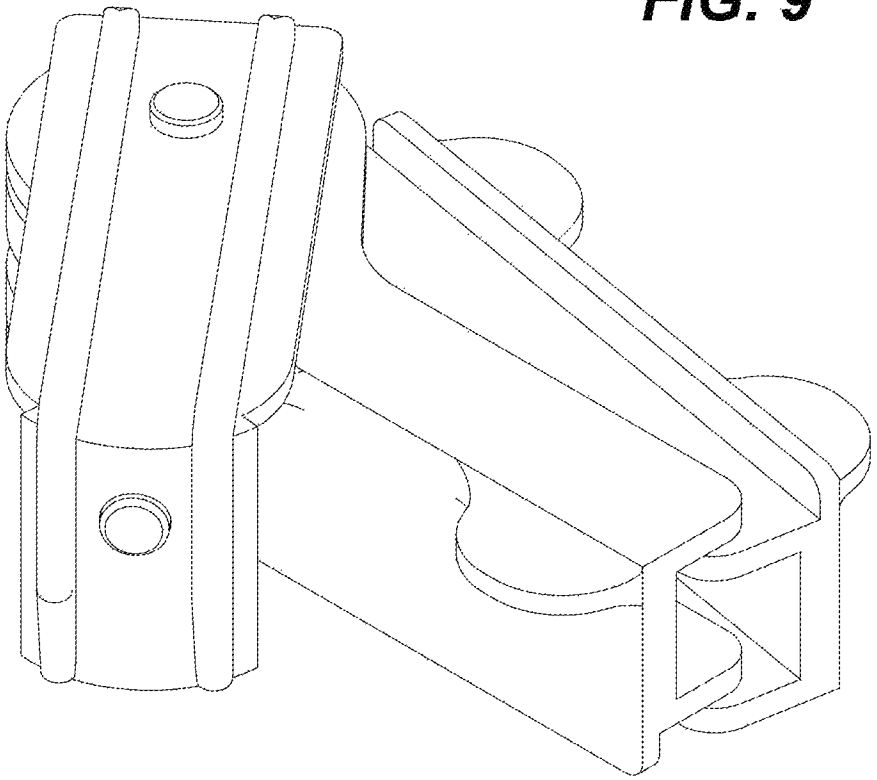
FIG. 9 is an isometric view, of the protracting blocker according to an embodiment of the present invention in its retracted configuration.

Referring now to any of FIGS. 1 through 3, a protracting blocker (10) for a door (12) is installed over a piston arm (14) of a closer piston (16). The protracting blocker (10) is comprised of a first and a second section (18, 18') wherein each of the sections (18, 18') is shaped like a "C" and comprises a top member (19), a bottom member (21) and a wall (20) to join the top and bottom members (19, 21). From the wall (20) extends generally perpendicularly at least one but preferably a plurality of tabs (22) so that the at least one tab (22) on each sections (18, 18') can rest on top of the piston arm (14). A retainer (24) presses against an elbow joint (26) forming part of the arm (14) so as to firmly press the wall (20) against the piston arm (14) so that one side of the blocker (10) is pressed up against one side of the piston arm (14) while the retainer (24) presses up against the opposite side of the piston arm (14). The piston (16) and piston arm (14) are well known in the art and need not be further discussed here. Suffice to say that the piston arm (14), much like a human arm, consists in an upper arm, an elbow, and a forearm. Here, the elbow joint (26) acts like a human elbow by bending and is hidden by a bracket (36) in FIG. 1. There is no need to explicitly show it because of general understanding of what the piston arm (14) is.

In order to block the arm (14) from moving, a lever (28) is actuated, which presses the two sections (18, 18') together so that they become immobilized and as such, immobilize the arm (14) as well.

The two sections (18, 18') are rotationally connected at an axis point (30) through which passes a rod (33) which has a means for biasing (34) at its distal end, and has the lever (28) pivotally attached at its proximal end. When the lever (28) presses against the first section (18) it pushes it against the second section (18'). More particularly, a first and a second sprocket (32, 32') meshes with a third and fourth sprocket (32", 32''') located on the second section (18') by way of sets of teeth (34) forming part of the sprockets (32, 32', 32", 32'''). This effectively immobilizes the two sections (18, 18'). The second section (18') has a bushing (35) which is the actual pivot point of the two sections (18, 18'), the rod (33) serving as a retainer for both sections (18, 18') as well as interacting with the lever (28) to create the blocking. Also, a bracket (36) for holding the triangular member (25) is pivotally attached on top of the first section (18) at the axis point by way of the rod (33) passing through a rod hole (31) located on the bracket (36).

Additional components include an opening (38) made through the bracket (36) so that a nipple (40) extending perpendicularly from the retainer (24) can be inserted therein to hold the retainer (24) in place. A pin (42) connects the lever (28) to the rod (33).

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

The invention claimed is:

1. A protracting blocker for a door having a closer piston with a piston arm wherein the protracting blocker is comprised of a first section and a second section; each section comprises a wall from which extends at least one tab extending perpendicularly therefrom so that the at least one tab on each of the first section and the second section rests on top of the piston arm; a retainer connected to a bracket presses against an elbow joint forming part of the piston arm so as to firmly press the wall against the piston arm so that one side of the blocker is pressed against one side of the piston arm while the retainer presses against the opposite side of the piston arm so as to provide a secure installation of the blocker on the piston arm; a lever pivoted into a horizontal position presses the two sections together so that they remain in a given fixed position relative to each other so as to immobilize the piston arm in a given position.

2. The protracting blocker of claim 1 wherein the first section and the second section are rotationally connected at an axis point through which passes a rod which has a means for biasing at its distal end, and has the lever pivotally attached at its proximal end.

3. The protracting blocker of claim 1 wherein when the lever presses against the second section, it pushes the first section against the second section.

4. The protracting blocker of claim 3 wherein a first and a second sprocket from the first section meshes with a third and fourth sprocket located on the second section by way of sets of teeth forming part of the first, second, third and fourth sprockets so as to immobilize the first section and the second section.

5. The protracting blocker of claim 2 wherein the rod holds the first section and the second section together by way of attaching with the lever by way of a pin.

6. The protracting blocker of claim 2 wherein the bracket holds the retainer and is pivotally attached on top of the first section at the axis point by way of the rod passing through a rod hole located on the bracket.

7. The protracting blocker of claim 6 wherein the bracket has an opening made through the bracket so that a nipple extending perpendicularly from the retainer can be inserted therein to hold the retainer in place.

8. The protracting blocker of claim 1 wherein the second section has a bushing acting as a pivot point for the first section and the second section.

9. The protracting blocker of claim 1 wherein the cross section of each of the first section and a second section is shaped like a "C" and comprises a top member, a bottom member and the wall to join the top member and bottom member.

10. A combination of a protracting blocker with a door having and a closer piston having a piston arm wherein the protracting blocker is comprised of a first section and a second section; each section comprises a wall from which extends at least one tab extending perpendicularly therefrom so that the at least one tab on each of the first section and the second section rests on top of the piston arm; a retainer connected to a bracket presses against an elbow joint forming part of the piston arm so as to firmly press the wall against the piston arm so that one side of the blocker is pressed against one side of the piston arm while the retainer presses against the opposite side of the piston arm so as to provide a secure installation of the blocker on the piston arm; a lever pivoted into a horizontal position presses the two sections together so that they remain in a given fixed position relative to each other so as to immobilize the piston arm in a given position.

11. The combination of claim 10 wherein the first section and the second section are rotationally connected at an axis point through which passes a rod which has a means for biasing at its distal end, and has the lever pivotally attached at its proximal end.

12. The combination of claim 10 wherein when the lever presses against the second section, it pushes the first section against the second section.

13. The combination of claim 12 wherein a first and a second sprocket from the first section meshes with a third and fourth sprocket located on the second section by way of sets of teeth forming part of the first, second, third and fourth sprockets so as to immobilize the first section and the second sections.

14. The combination of claim 11 wherein the rod holds the first section and the second section together by way of attaching with the lever by way of a pin.

15. The combination of claim 11 wherein the bracket holds the retainer and is pivotally attached on top of the first section at the axis point by way of the rod passing through a rod hole located on the bracket.

16. The combination of claim 15 wherein the bracket has an opening made through the bracket so that a nipple extending perpendicularly from the retainer can be inserted therein to hold the retainer in place.

17. The combination of claim 10 wherein the second section has a bushing acting as a pivot point for the first section and the second section.

18. The combination of claim 10 wherein the cross section of each of the first section and a second section is shaped like a "C" and comprises a top member, a bottom member and the wall to join the top member and bottom member.

* * * * *